United States Patent [19]

Masadi

[11] Patent Number: 4,868,940

[45] Date of Patent: Sep. 26, 1989

[54] CUSHIONING MAT FOR USE AS PORTABLE BEDDING

[75] Inventor: Rizalah Masadi, Woonsocket, R.I.

[73] Assignee: The United States of America as represented by the Secretary of the Army, Washington, D.C.

[21] Appl. No.: 290,593

[22] Filed: Dec. 27, 1988

[51] Int. Cl.[4] ..... A47G 9/06

[52] U.S. Cl. ..... 5/417; 5/420; 428/159

[58] Field of Search ..... 5/417–420, 5/465; 428/159, 160

[56] References Cited

U.S. PATENT DOCUMENTS 2,751,609 6/1956 Oesterling et al. ..... 5/420

4,766,626 8/1988 Green ..... 5/420

FOREIGN PATENT DOCUMENTS 195205 3/1965 Sweden ..... 5/420

*Primary Examiner*—Alexander Grosz

*Attorney, Agent, or Firm*—Lawrence E. Labadini; Robert P. Gibson; Anthony T. Lane

[57] ABSTRACT

Portable mattresses having improved comfort and lower bulk when folded for transport are provided. The mattresses include generally planar members having corrugations on each face of the planar member. The corrugations are such that the planar members are adapted to be brought into nesting relationship when the mat is folded.

14 Claims, 1 Drawing Sheet

CUSHIONING MAT FOR USE AS PORTABLE BEDDING

BACKGROUND OF THE INVENTION

The invention described herein may be manufactured, used and licensed by or for the government for governmental purposes without the payment to us of any royalties thereon.

Portable mats for use as portable bedding materials have long been known in the art. From earliest times mats of, e.g., straw, feathers, etc., have been used as bedding materials. In most recent times, inflatable mattresses and mattresses formed of polymeric foam have been employed. Mattresses formed of closed-cell foams are particularly desirable since they afford relatively high degrees of insulation.

However, while such mattresses offer the advantage of high insulation properties and relative portability, they possess the disadvantage that they are difficult to readily fold and when folded or rolled still retain substantial bulk. A further disadvantage of closed-cell foam mats resides in the trade-off between bulk and comfort; low bulk mats provide less cushioning.

Durable closed-cell foam sleeping mats have been adopted as standard items by the military of many countries and have also found widespread use among sports persons because of their high insulation, light weight, durability to the rigors of field use and for their water-imperviousness. However, they are not as comfortable as air-mattresses and other sleeping devices and are bulky and awkward to carry. Both of these disadvantages result from their relatively incompressible closed-cell foam construction which is necessary to provide thermal efficiency, insulation, water imperviousness, and durability.

In an attempt to overcome these deficiencies, mats have been constructed in segmented panels such that they can be folded in various rectangular configurations which are less awkward and slightly less bulky than a typical rolled tube configuration discussed above. However, these configurations provide no comfort improvement.

In an attempt to improve the comfort provided by such mats, while retaining the relatively incompressible closed-cell foam structure, mats have been manufactured in a "ridged" construction (as opposed to a perfectly flat construction). The ridges or hills and valleys significantly increase both the effective thickness of the mattress and the compressibility/resiliency of the mat, thereby substantially increasing the comfort provided by the mat, while retaining its basic insulating and durability characteristics. Unfortunately, this comfort advantage is achieved at the expense of a considerable increase in bulk, in either rolled or folded panel configuration. Accordingly, previous portable sleeping mat constructions and configurations do not provide the optimum comfort level while still allowing for optimum low bulk storage and affordability.

SUMMARY OF THE INVENTION

This invention provides portable sleeping mats which retain the advantages of closed-cell foam construction, but which also optimize the ability of flat panels to fold into a stacked sequence of low bulk. The mats of this invention also provide increased comfort, in comparison with closed-cell foam mats of corresponding thicknesses or depths.

These and other advantages are attained by providing a mat for use as portable bedding comprising a generally planar sheet of resilient, plastic foam material, the sheet having a first and a second side and a longitudinal dimension, a transverse dimension and a depth dimension which is transverse to the plane of the longitudinal dimension and the transverse dimension. The sheet also comprises a longitudinal fold line, comprising a longitudinally-extending portion adapted to form a hinge, and transverse fold lines comprising transversely-extending portions adapted to form a hinge. The longitudinal fold line and the transverse fold lines define repeating generally planar units, each unit having a first face, a second face and a periphery comprising four peripheral edges at least some of which are defined by the hinges. The first face of each unit comprises a first repeating corrugated pattern, or periodic pattern of projections and recesses, and the second face comprises a second corrugated pattern, or periodic pattern of projections and recesses, capable of nesting within the pattern of the first face. The repeating planar units are sequenced such that the first face of any planar unit adjoining another planar unit at a peripheral edge is on the opposite side of the mat from the first face of the adjoining planar unit.

DETAILED DESCRIPTION OF THE INVENTION

Figure 1:
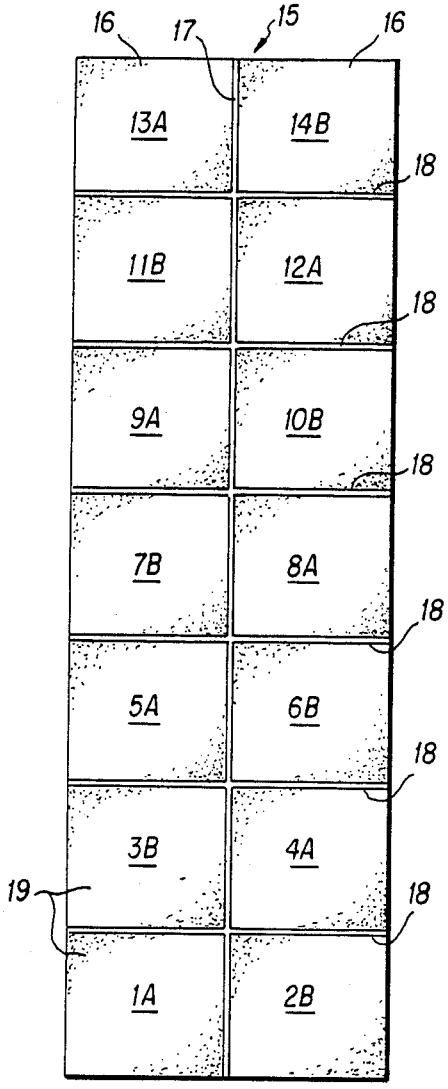
FIG. 1 is a schematic plan view of a mat constructed in accordance with one embodiment of this invention, showing individual panels of the mat.
Figure 2:
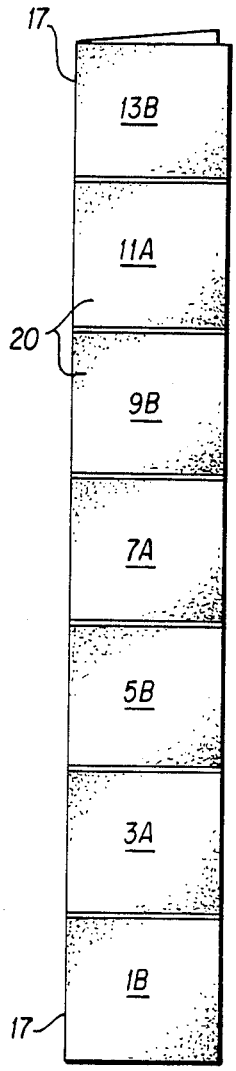
FIG. 2 is a schematic plan view of the mat folded upon itself along its longitudinal axis.

Referring to FIG. 1, there is shown, schematically, a mat or mattress of this invention designated generally as 15 for use as portable bedding. The mat comprises two sides or faces, a first (upper) face 19, that is exposed in the plan view of FIG. 1, and a second (lower) face 20, a portion of which is exposed in the plan view of FIG. 2. The mat comprises a longitudinally extending fold line, i.e., a portion readily adapted to be folded which, for example, acts as a hinge 17. The mat is also provided with transverse fold lines 18 which are also adapted to be folded and act as hinges. The longitudinal fold line 17 and transverse fold lines 18 cooperate to define generally planar units 16. Each planar unit 16 has two faces on its opposite surfaces, i.e., a first face A and a second face B. Each planar unit also has a peripheral portion, defined by the longitudinal and transverse fold lines and the edges of the mat. The two faces A and B of each planar unit are provided with corrugations. The corrugations are disposed in a specialized pattern.

The corrugations on the second, lower face B of each planar unit are complementary to the corrugations on the upper face A of each planar unit. Thus, the corrugations on the second or lower face B are adapted to nest or mate with the corrugation on the upper face A of an adjacent planar unit. As can be seen from the plan view of the FIGS. 1 and 2, the planar units are sequenced and oriented such that when the mat is folded along the longitudinal and transverse fold lines, the corrugations of each second or lower face B nest into the corrugations on the confronting, or first upper face A.

Figure 4:
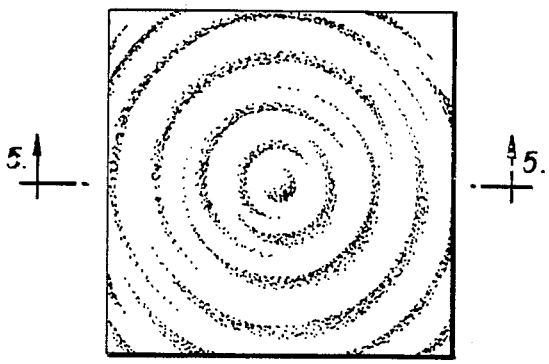
FIG. 4 is a schematic plan view of one face of one planar panel unit of the mat. This unit is corrugated in a circular corrugated pattern in accordance with one preferred embodiment of the invention.

A preferred corrugated pattern is shown in FIG. 4. This pattern comprises circular corrugations, i.e., from the perspective of a plan view, the corrugations comprise alternate rings of projections and recesses. It will be readily understood by those of ordinary skill in the art that other patterns can be employed as well. Examples of suitable patterns include polygonal patterns, ellipsoidal patterns, etc.

It will be readily apparent to skilled workers that the alternating areas of projections and recesses need not extend throughout the entire thickness of the generally planar units. In such embodiments, the upper and lower faces of the planar units are provided with the alternating areas of projections and recesses which extend from and into, respectively, the planar body of the planar units.

Figure 5:
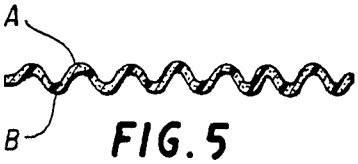
FIG. 5 a cross-sectional view of the unit of FIG. 4 taken along the line 5—5 of FIG. 4, looking in the direction of the arrows.

In a preferred embodiment, the entire thickness of the generally planar member is corrugated. This is schematically illustrated in FIG. 5, which is a cross-sectional view taken along line 5—5 of FIG. 4. Thus, generally planar structures include those wherein the unit is formed with corrugations that extend through its entire thickness. Thus, the upper surface A has corrugations which are complementary to the corrugations of the lower surface B. Thus, the corrugations of the lower surface are capable of nesting within the corrugations of the confronting upper surface of a similar unit.

The mats can be formed of any foamed material having the desired structural and insulative properties. However, foamed polyethylene, most preferably closed cell foamed polyethylene, is preferred. Additionally, ethylene vinyl acetate-ethylene copolymers, polyurethane and rubber-based polymers can be used. Suitable formulations will be readily apparent to those of ordinary skill in the art and are fully conventional.

The mat can be formed in any fully conventional manner well-known to those of ordinary skill in the art. For example, the mat can be formed in a flat, ribbonlike configuration by a continuous extrusion process followed, downstream of the extrusion, by stamping or embossing, as with a heated die, to form the fold lines and corrugations. Preferably, the fold lines comprise hinges which are integral with and formed of the same material as the mat. Thus, in the area of the fold line, the foam is compressed to form an integral hinge. The corrugated pattern is preferably formed by embossing. Most preferably, the corrugated pattern is formed to extend throughout the structure of each planar unit as shown in FIG. 5. Other ways of forming the mat, fold lines or hinges and the corrugations will be readily apparent to those of ordinary skill in the art.

The mat is shown in its extended configuration, as for sleeping upon, in FIG. 1. To fold for transport, the mat is folded about its longitudinal axis so that the confronting faces of adjacent planar units A and B are brought into engaged, nesting relationship. Thus, the face of unit 13A confronts and engages the face 14B, as do the respective faces 11B, 12A; 9A, 10B; 7B, 8A; etc., as illustrated schematically in FIG. 2.

Figure 3:
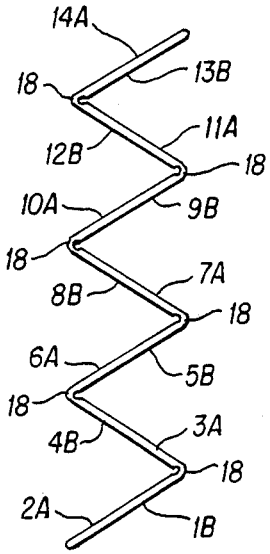
FIG. 3 is a schematic end view showing how the mat, when folded about its longitudinal axis as shown in FIG. 2, can be folded about transverse fold lines in accordion fashion, to permit further folding to form a compact stack.

The mat, thus folded, is then folded in accordion-like fashion as shown in FIG. 3 to permit it to be folded further to form a compact bundle or stack. Thus, face 14A (the opposite face of 14B) is in an outer, exposed condition, while 13B is in contact with 11A; 12B is in contact with 10A, etc. In each of the above, the projections and recesses of surface B is nested within the projections and recesses of surface A, such that only the thickness of the mat, not the thickness of the amplitude of the corrugations, is added to the thickness of the folded mat.

As can be readily ascertained from FIG. 1, the fold lines also define rows of planar units. Thus, the longitudinal fold line defines, in part, two rows of planar units. It will be readily apparent to those of ordinary skill in the art that any number of rows of panels can be employed so long as the sequence and orientation of the planar units are as defined above. Any number of transverse rows may be employed as well.

The mats of this invention provide improved comfort. This is due, in part, to the corrugations of the planar members. The corrugations, and thus the nestability of the planar units, also contribute to the ability of the mat to be folded in a compact configuration. The corrugations thus stack one upon another. Thus, the stack along the depth dimension of the planar members increases in height only by the thickness of the sheet of the mat, i.e., the thickness of the sheet of the planar member. It does not increase by the overall thickness of the corrugations.

What is claimed is:

1. A mat for use as portable bedding, comprising:

a generally planar sheet of resilient foam material, said sheet having a first side and a second side and a longitudinal dimension, a transverse dimension and a depth dimension which is transverse to the plane of the longitudinal dimension;

said sheet comprising a longitudinal fold line, said fold line comprising a longitudinally-extending portion adapted to form a hinge, and transverse fold lines comprising transversely-extending portions adapted to form hinges;

said longitudinal fold line and said transverse fold lines defining repeating generally planar units, each unit having a first face, a second face on the opposite side of each unit and a periphery comprising four peripheral edges, at least some of which are defined by said hinges;

said first face of each unit comprising a first repeating pattern of periodic projections and recesses;

said second face comprising a second pattern of periodic projections and recesses, said first pattern capable of nesting or mating within said second pattern;

said repeating planar units being sequenced such that the first face of any planar unit adjoining another planar unit at a peripheral edge is on the opposite side of the mat from the first face of the adjoining planar unit.

2. A mat of claim 1 wherein said patterns comprise corrugations.

3. A mat of claim 2 wherein the patterns of said first face and said second face comprise corrugations formed into the generally planar structure of the mat.

4. A mat of claim 3 wherein the corrugated pattern comprises repeating generally circular corrugations.

5. A mat of claim 3 wherein the corrugated pattern comprises repeating generally ellipsoidal corrugations.

6. A mat of claim 3 wherein the corrugated pattern comprises repeating generally polygonal corrugations.

7. A mat of claim 1 wherein said longitudinal and said transverse fold lines each, independently comprise an integral hinge formed of and integral with the material of the mat.

8. A mat of claim 1 wherein said foam is a closed-cell foam.

9. A mat of claim 8 wherein said foam comprises polyethylene.

10. A mat of claim 9 wherein said foam comprises cross-linked polyethylene.

11. A mat of claim 8 wherein said foam further comprises ethylene vinyl acetate.

12. A mat of claim 8 wherein said foam comprises polyurethane.

13. A mat for use as portable bedding, comprising:

a generally planar sheet of resilient, closed-cell foam, said sheet having a first side and a second side, a longitudinal dimension, a transverse dimension, and a depth dimension which is transverse to the longitudinal and transverse dimensions;

said sheet comprising at least one longitudinal fold line comprising an integral hinge formed of said foam, and integral with the mat, and transverse fold lines comprising transversely extending integral hinges formed of said foam, and integral with the mat;

said fold lines defining repeating planar units having a first face, a second face on the opposite side of said planar unit and a periphery comprising four peripheral edges at least some of which are defined by said hinges;

said generally planar units comprising circular corrugations such that said first face of said planar units comprises a circular corrugated pattern and said second face of said planar units comprises a corresponding circular corrugated pattern capable of nesting within the pattern of a first face;

said repeating planar units being sequenced and oriented such that the first face of any unit which unit adjoins another unit at a peripheral edge, is on the opposite side of the mat from the first face of the adjoining planar unit.

14. A mat of claim 13 wherein said circular corrugations are concentric.

* * * * *